US008747086B2

(12) United States Patent
Chikano et al.

(10) Patent No.: US 8,747,086 B2
(45) Date of Patent: Jun. 10, 2014

(54) SCROLL COMPRESSOR

(75) Inventors: Masatsugu Chikano, Mito (JP); Kazuo Sakurai, Shizuoka (JP); Mutsunori Matsunaga, Shizuoka (JP); Satoshi Nakamura, Shizuoka (JP)

(73) Assignee: Hitachi Appliances, Inc., Tokyo (JP)

( * ) Notice: Subject to any disclaimer, the term of this patent is extended or adjusted under 35 U.S.C. 154(b) by 791 days.

(21) Appl. No.: 12/914,002

(22) Filed: Oct. 28, 2010

(65) Prior Publication Data

US 2011/0103990 A1 May 5, 2011

(30) Foreign Application Priority Data

Oct. 30, 2009 (JP) ..... 2009-250280

(51) Int. Cl.

| | |
|---|---|
| ***F04C 18/02*** | (2006.01) |
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/00*** | (2006.01) |
| ***F04C 15/00*** | (2006.01) |

(52) U.S. Cl.

USPC ..... 418/55.2; 418/55.1; 418/55.3; 418/55.4; 418/55.5; 418/55.6; 418/151; 418/178; 418/179

(58) Field of Classification Search

USPC ..... 418/55.1–55.6, 151, 178, 179

See application file for complete search history.

(56) References Cited

U.S. PATENT DOCUMENTS

| | | | | |
|---|---|---|---|---|
| 2007/0178002 | A1* | 8/2007 | Hiwata et al. | 418/55.2 |
| 2010/0202911 | A1* | 8/2010 | Ni et al. | 418/55.2 |

FOREIGN PATENT DOCUMENTS

| | | |
|---|---|---|
| CN | 101418791 A | 4/2009 |
| JP | 55-010369 | 1/1980 |
| JP | 02-173301 | 7/1990 |
| JP | 08-261172 | 10/1996 |
| JP | 08-261173 | 10/1996 |
| JP | 2006-144635 | 6/2006 |

OTHER PUBLICATIONS

JP Office Action of Appln. 2009-250280 dated Jan. 8, 2013 with partial English translation.

* cited by examiner

*Primary Examiner* — Thomas Denion
*Assistant Examiner* — Dapinder Singh
(74) *Attorney, Agent, or Firm* — Antonelli, Terry, Stout & Kraus, LLP.

(57) ABSTRACT

A scroll compressor is constructed by combining a stationary scroll and an orbiting scroll formed by erecting a scroll-shape wrap upright on a base plate meshing with each other. A scroll member constructing the stationary scroll or the orbiting scroll is constructed of an inner layer member 601 forming a core metal and an outer layer member 600 arranged so as to surround the inner layer member and forming an outer layer part, the inner layer member is constructed of a material with higher modulus of elasticity than that of the outer layer member, and separation prevention parts (uneven parts 603, depressions 604, or holes 605) preventing the inner layer member and the outer layer member from separating with each other due to difference in coefficient of thermal expansion thereof are arranged in the inner layer member.

9 Claims, 3 Drawing Sheets

SCROLL COMPRESSOR

BACKGROUND OF THE INVENTION

1. Field of the Invention

The present invention relates to a scroll compressor suitable to a refrigerant compressor used for a refrigeration cycle for refrigeration and air conditioning or to a gas compressor for compressing gas such as the air and other gas.

2. Description of the Related Art

The scroll compressor is constructed by combining a stationary scroll and an orbiting scroll, and cast iron or aluminum alloy is generally employed as the material of a scroll member of the stationary scroll and the orbiting scroll. Further, there is also a combination of cast iron for the stationary scroll and aluminum alloy for the orbiting scroll.

Also, as described in Japanese Published Unexamined Patent Application No. H08-261172 and No. H08-261173, scroll members using two or more kinds of aluminum alloys are known.

In one described in Japanese Published Unexamined Patent Application No. H08-261172, the stationary scroll or the orbiting scroll is made a combination of two or more layers of aluminum alloys with the vicinity of the center part being constructed of a first material and with the vicinity of the outer peripheral part being constructed of a second material, and is formed by forging with two or more kinds of the aluminum alloys.

Also, Japanese Published Unexamined Patent Application No. H08-261173 describes one in which the stationary scroll or the orbiting scroll is made a combination of two or more layers of upper and lower faces of aluminum alloy materials and is formed by forging with two or more kinds of aluminum alloys.

In the prior art, when the scroll member is manufactured of cast iron, there is a problem that the centrifugal force increases in high speed rotation, and the load on bearings increases.

Also, when the scroll member is manufactured of an aluminum alloy, the weight can be reduced, however the thickness of the member is required to be made thick in order to suppress deformation of the member due to the load generated during the compression step of the scroll member. Therefore, there is a problem that the size of the member becomes large and the whole compressor becomes of a large scale. Further, when the material strength of the whole scroll member is to be increased to bear the load, there is a problem that the scroll member becomes expensive.

Also, as described in the Japanese Published Unexamined Patent Application No. H08-261172 and No. H08-261173, even those with the combination of two or more layers of two or more kinds of aluminum alloys have the difficulty in greatly increasing the rigidity of the scroll member and have the problem that the scroll member becomes expensive.

SUMMARY OF THE INVENTION

Accordingly, an object of the present invention is to obtain a scroll compressor having a scroll member light in weight, high in rigidity, and inexpensive in manufacturing.

In order to solve the problems, the present invention is characterized that in a scroll compressor constructed by combining a stationary scroll and an orbiting scroll formed by erecting a scroll-shape wrap upright on a base plate meshing with each other, a scroll member constructing the stationary scroll or the orbiting scroll is constructed of an inner layer member forming a core metal and an outer layer member arranged so as to surround the inner layer member and forming an outer layer part, the inner layer member is constructed of a material with higher modulus of elasticity than that of the outer layer member, and separation prevention parts preventing the inner layer member and the outer layer member from separating with each other due to difference in coefficient of thermal expansion thereof are arranged in the inner layer member.

Here, the separation prevention parts are preferable to be at least any of a plurality of uneven parts, depressions, or holes formed in the inner layer member. Also, the plurality of uneven parts, depressions, or holes constructing the separation prevention part are preferable to be arranged more densely on the wrap center part side than on the wrap outer peripheral part side of the scroll member.

Further, it is preferable that the outer layer member constructing the scroll member is constructed of a non-ferrous metal lighter in weight than the material of the inner layer member and that the inner layer member is constructed of an iron-based metal having at least two times or higher modulus of elasticity than that of the outer layer member. In particular, it is preferable that the outer layer member is constructed of an aluminum alloy and the inner layer member is constructed of a steel plate or a steel material. Furthermore, it is preferable that the steel plate or the steel material constructing the inner layer member is either of SPHC or SPHE stipulated in the Japanese Industrial Standards (JIS).

Other feature of the present invention is that in a scroll compressor constructed by combining a stationary scroll and a orbiting scroll formed by erecting a scroll-shape wrap upright on a base plate meshing with each other, at least either of the wrap or the base plate of a scroll member constructing the stationary scroll or the orbiting scroll is constructed of an inner layer member forming a core metal and an outer layer member arranged so as to surround the inner layer member and forming an outer layer part, the inner layer member is constructed of a material with higher modulus of elasticity than that of the outer layer member, and separation prevention parts preventing the inner layer member and the outer layer member from separating with each other due to difference in coefficient of thermal expansion thereof are arranged in the inner layer member.

Here, when the inner layer member is arranged at least in a wrap section of the orbiting scroll, the strength of the wrap section whose thickness cannot be increased much can be sufficiently improved. Also, if the inner layer member is arranged so as to extend in both a wrap section and a base plate section of the orbiting scroll, the strength of the scroll member can be further improved. In particular, it is preferable that the inner layer member is constructed of a disk-shape member disposed in the base plate section and a scroll-shape member disposed in the wrap section and that the disk-shape member and the scroll-shape member are formed integrally. Further, because the inner layer member is constructed of a material with higher modulus of elasticity than that of the outer layer member, the thickness of the scroll-shape member can be made a half or less of the thickness of the whole wrap section.

Further other feature of the present invention is that, in a scroll compressor constructed by combining two scroll members formed by erecting a scroll-shape wrap upright on a base plate meshing with each other and used for a refrigeration cycle, a wrap and base plate section of the scroll member is constructed of an inner layer member forming a core metal and an outer layer member arranged so as to surround the inner layer member and forming an outer layer part, the inner layer member is constructed of a material with higher modulus of elasticity than that of the outer layer member, and separation prevention parts preventing the inner layer member and the outer layer member from separating with each other due to difference in coefficient of thermal expansion thereof are arranged in the inner layer member.

Also, it is preferable that the adhesiveness with the outer layer member is improved with the surface of the inner layer member being subjected to surface treatment including zinc.

According to the present invention, the scroll member constructing the stationary scroll or the orbiting scroll is constructed of an inner layer member forming a core metal and an outer layer member arranged so as to surround the inner layer member and forming an outer layer part, the inner layer member is constructed of a material with higher modulus of elasticity than that of the outer layer member, separation prevention parts preventing the inner layer member and the outer layer member from separating with each other due to difference in coefficient of thermal expansion thereof are arranged in the inner layer member, and therefore a scroll compressor having a scroll member light in weight, high in rigidity, and inexpensive in manufacturing can be obtained.

DESCRIPTION OF THE PREFERRED EMBODIMENTS

The present invention will be more fully understood from the following description of the preferred embodiments where reference is made to the accompanying drawings.

Embodiment 1

Figure 1:
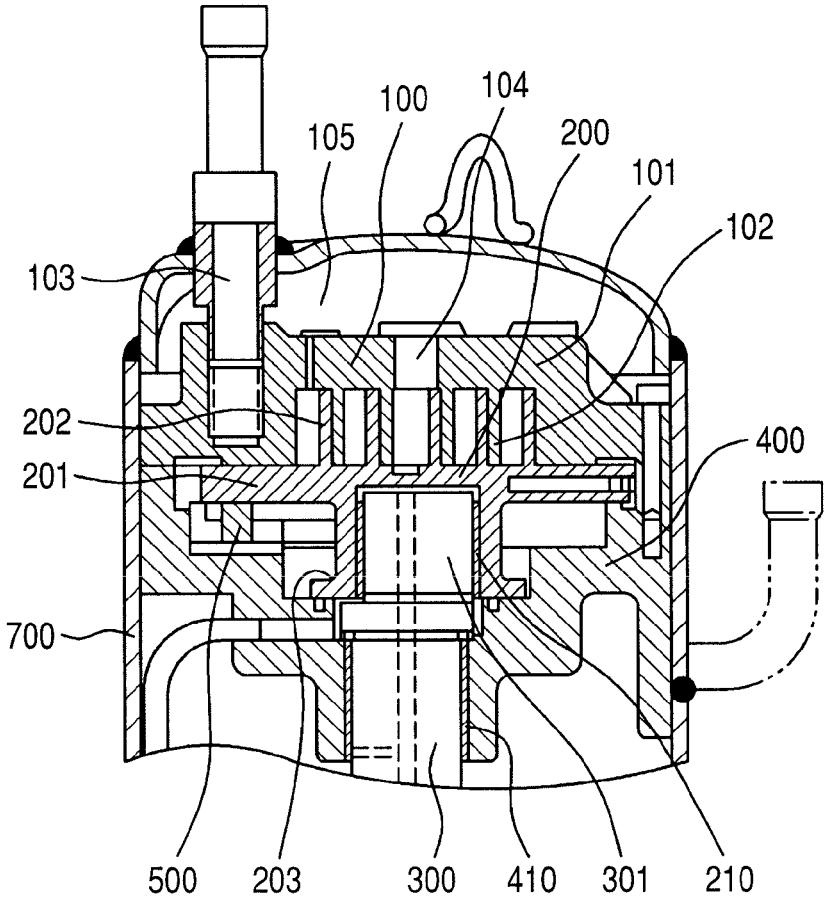
FIG. 1 is a vertical sectional view of a principal part of a scroll compressor showing an embodiment of the present invention.

FIG. 1 is a vertical sectional view showing a principal part of a scroll compressor. A compression mechanism is arranged inside a sealed vessel 700, and the compression mechanism is driven by a rotary shaft 300 and compresses gas. The compression mechanism is constructed of a stationary scroll 100 in which a scroll-shape wrap 102 is erected upright on a base plate 101 and an orbiting scroll 200 in which a scroll-shape wrap 202 is erected upright on a base plate 201 with the wraps being meshed with each other. Also, in the stationary scroll 100, a suction port 103 is arranged on the outer peripheral side and a discharge port 104 is arranged in the center part. A crank pin 301 is arranged at the edge of the rotary shaft 300, and the crank pin 301 is inserted into a boss 203 projectingly arranged on the back face (opposite to the wrap) of the base plate 201 of the orbiting scroll 200. A turning bearing 210 is arranged inside the boss 203 and slides with respect to the crank pin 301. A rotation prevention joint 500 is disposed on the back face of the base plate 201 of the orbiting scroll 200. The rotation prevention joint 500 is a joint that works as a rotation prevention mechanism allowing the orbiting scroll 200 turn without rotating with respect to the stationary scroll 100, and is arranged between the orbiting scroll 200 and a frame 400. The frame 400 is fixed to the inner surface of the sealed vessel 700, and the rotary shaft 300 is supported by the frame 400 through a main bearing 410.

In the compression mechanism, when the rotary shaft 300 rotates, the crank pin 301 eccentrically rotates and the orbiting scroll 200 performs turning motion without rotating with respect to the stationary scroll 100 by the rotation prevention joint 500. Thus, the gas sucked through the suction port 103 is introduced to a sealed chamber (compression chamber) formed by the wraps 102 and 202 from a suction chamber on the outer peripheral side of the wrap. Accompanying the turning motion of the orbiting scroll, the sealed chamber reduces its own volume while moving toward the center side and compresses the sucked gas, and the compressed gas is discharged to a discharge chamber 105 through the discharge port 104 formed in the stationary scroll.

Figure 2:
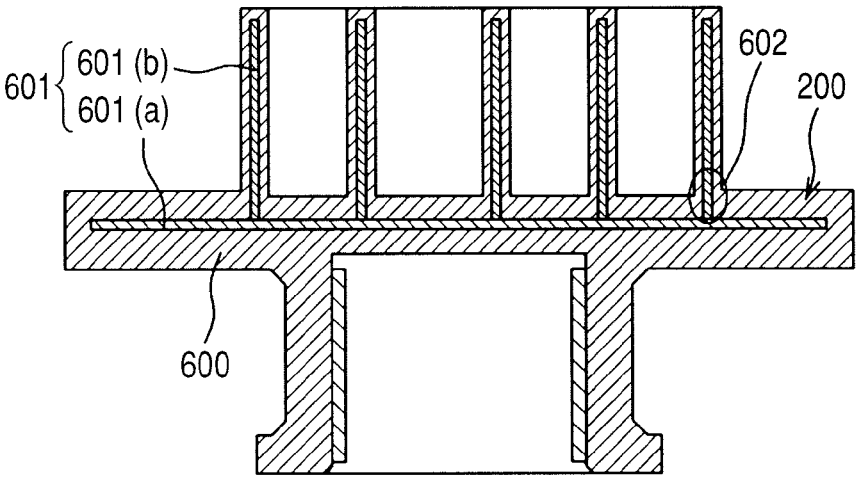
FIG. 2 is a vertical sectional view of an orbiting scroll shown in FIG. 1.

FIG. 2 is a vertical sectional view showing the orbiting scroll 200 shown in FIG. 1 in a magnified manner. The orbiting scroll 200 is formed of an outer layer member 600 and an inner layer member 601, and the inner layer member 601 is covered with the outer layer member 600. Also, the outer layer member 600 is constructed of a material whose weight is lighter in weight than that of the inner layer member 601, and the material constructing the inner layer member 601 is of a material with higher modulus of elasticity than that of the material constructing the outer layer member 600.

It is preferable that the outer layer member 600 is constructed of a light-weight non-ferrous metal and that the inner layer member 601 is constructed of an iron-based metal having two times or higher modulus of elasticity (strength) than that of the outer layer member. Thus, the thickness of the inner layer member 601 can be made approximately 20-60% for embodiment of the thickness of the wrap section, thereby both of sufficient strength and sufficient weight reduction can be attained, and manufacturing becomes easy due to the thickness suitable to manufacturing. Because the thickness of the whole wrap section is approximately 3-4 mm in normal, it is preferable that the thickness of the inner layer member is made approximately 0.6-2.4 mm.

Thus, the inner layer member 601 with high strength comes to function as a core metal of the scroll member, and the rigidity of the scroll member can be greatly improved compared with the case the scroll member is constructed of only the material of the outer layer member 600. For example, by employing an aluminum alloy which is a non-ferrous metal for the outer layer member 600 and employing a steel plate and a steel material such as SPHC and SPHE stipulated in JIS Standards having modulus of elasticity of approximately 3 times of that of an aluminum alloy for the inner layer member 601, the rigidity can be remarkably improved compared with the case the scroll member is constructed of an aluminum alloy only.

In a scroll member according to the present embodiment, deformation of the scroll member during operation is inhibited because the rigidity is improved, therefore the leakage loss from the compression chamber (sealed chamber) constructed by meshing of the wraps can be reduced, and a compressor with high performance can be obtained. Also, because a steel plate and a steel material more inexpensive than an aluminum alloy are employed for the inner layer member, manufacturing at less cost than the case the scroll member is constructed of an aluminum alloy only becomes possible.

Also, according to the present embodiment, the inner layer member 601 is constructed of a disk-shape member 601(*a*)

and a scroll-shape member 601(*b*). The rigidity of the base plate (end plate) can be improved by the disk-shape member 601(*a*), and the rigidity of the scroll wrap can be improved by the scroll-shape member 601(*b*). Also, as shown in the area of 602 in FIG. 2, the scroll-shape member 601(*b*) is arranged so as to extend in both the scroll wrap and the base plate, therefore the rigidity at a root of the scroll wrap where the load is particularly concentrated can be improved, and deformation of the scroll wrap can be inhibited.

The orbiting scroll 200 can be manufactured by, for example, melting metal material constructing the outer layer member 600, and casting the inner layer member 601 by the molten metal. By employing a non-ferrous metal such as an aluminum alloy for the outer layer member and employing an iron-based metal such as a steel plate and a steel material for the inner layer member, easy manufacturing is possible because the melting point of the both is different with each other. That is, because the melting point of the inner layer member 601 is higher than that of the outer layer member 600, the inner layer member 601 can be casted by the molten outer layer member 600 while maintaining the shape of the inner layer member 601.

Also, in the embodiment shown in FIG. 2, the case the present invention was applied to the orbiting scroll 200 was explained, however similar manufacturing is possible also in the case the present invention is applied to the stationary scroll 100.

Next, embodiments of preferable shapes of the inner layer member 601 of the orbiting scroll according to the present embodiment will be explained referring to FIG. 3-FIG. 5.

Figure 3:
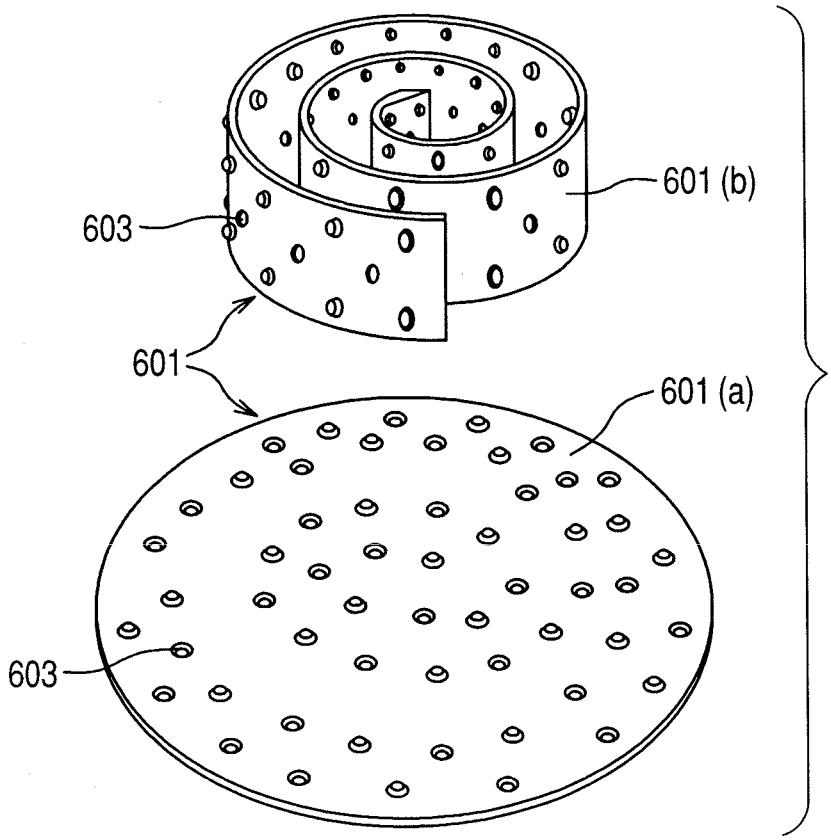
FIG. 3 is a schematic drawing showing an embodiment of an inner layer member of the orbiting scroll shown in FIG. 2.

In the embodiment shown in FIG. 3, uneven parts 603 (separation prevention parts) are arranged by formation by press working and the like on the surface of each of the disk-shape member 601(*a*) and the scroll-shape member 601(*b*) constructing the inner layer member 601 of the orbiting scroll. That is, projections and recesses are formed on one face (front surface) of each inner layer member 601, whereas recesses and projections are respectively formed on the other face (back surface) at the locations corresponding to the projections and recesses. Thus, by arranging the projections and recesses on respective faces of the inner layer member, the shearing stress generated due to the difference in the coefficient of thermal expansion between the inner layer member and the outer layer member can be received by the projections of the inner layer member where the strength is high, and the separation prevention effect between the inner layer member and the outer layer member is increased.

Also, FIG. 3 shows an embodiment in which the disk-shape member 601(*a*) and the scroll-shape member 601(*b*) are constructed as separate bodies.

Figure 4:
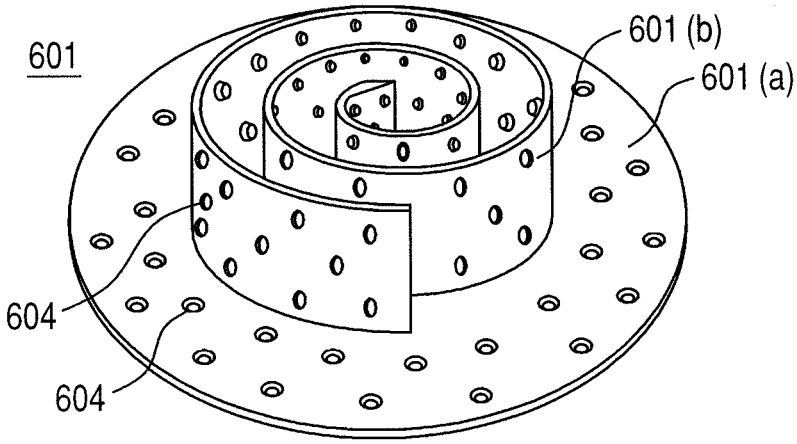
FIG. 4 is a schematic drawing showing another embodiment of an inner layer member of the orbiting scroll shown in FIG. 2.

In the embodiment shown in FIG. 4, only depressions (recesses) 604 (separation prevention parts) are formed by press working and the like on one face (front surface) of the inner layer member 601 constructing the orbiting scroll, whereas projections are shaped at the locations corresponding to the depressions on the other face (back surface). In the embodiment shown in FIG. 4, only the depressions are formed on one face and only the projections are shaped on the other face at the locations corresponding to the depressions accompanying the formation of the depressions, and therefore manufacturing is easier than in the embodiment shown in FIG. 3.

Also, in the embodiment shown in FIG. 4, the disk-shape member 601(*a*) and the scroll-shape member 601(*b*) are integrally formed.

By arranging the separation prevention parts such as the uneven parts 603 and the depressions 604, not only separation of the inner layer member and the outer layer member can be prevented, but also rigidity of the inner layer member is further increased and rigidity of the scroll member can be further improved because the uneven parts 603, the depressions 604 and the like are shaped. Also, because the contact area between the inner layer member 601 and the outer layer member 600 can be increased, adhesiveness between the inner layer member 601 and the outer layer member 600 can be improved. In the present embodiment, because a steel plate, for example, is employed for the inner layer member and an aluminum alloy, for example, is employed for the outer layer member, shearing stress is generated between the inner layer member and the outer layer member during operation of the scroll compressor due to the difference in the coefficient of thermal expansion and the like between the inner layer member and the outer layer member. However, according to the present embodiment, as described above, because adhesiveness between the inner layer member 601 and the outer layer member 600 can be improved due to the uneven parts 603 and the depressions 604, the retaining force stronger than the shearing stress can be secured, and separation (detachment) of the inner layer member and the outer layer member can be prevented. Also, because the inner layer member can sufficiently function as a core metal, rigidity of the scroll member can be improved and a scroll compressor having a highly reliable scroll member in which internal crack, detachment and the like do not occur can be obtained.

Figure 5:
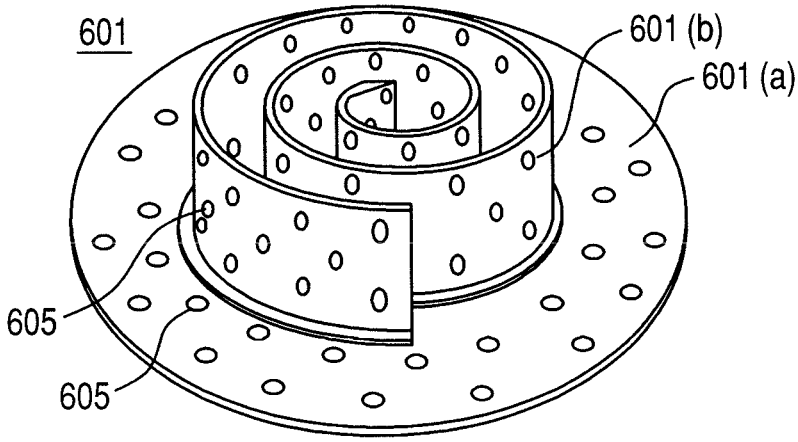
FIG. 5 is a schematic drawing showing further other embodiment of an inner layer member of the orbiting scroll shown in FIG. 2.

In the embodiment shown in FIG. 5, holes 605 are bored through the inner layer member 601 from the top surface to the back surface. With this configuration, adhesiveness between the inner layer member 601 and the outer layer member 600 can be improved due to encroachment of the outer layer member 600 into the holes 605. In the present embodiment also, similar to in the embodiments shown in FIG. 3 and FIG. 4, a scroll compressor having a scroll member with high rigidity and reliability can be obtained. Further, in the present embodiment, the holes 605 may not only be the through holes but may be in the shape of a bottomed hole.

In the embodiments, it is preferable that the uneven parts 603, depressions 604 and holes 605 are arranged more densely on the center part side that is the winding-start side of the wrap of the scroll-shape member 601(*b*). In other words, the center part side of the wrap is subjected to higher temperature and higher pressure than in the outer peripheral side of the wrap accompanying operation of the scroll compressor, and therefore the shearing stress due to the difference in the coefficient of thermal expansion and the like between the inner layer member and the outer layer member is higher there. By arranging the uneven parts 603 and the like more densely on the center part side of the wrap, adhesiveness between the inner layer member and the outer layer member can be improved, a rigid scroll member that can cope with the magnitude of the shearing stress mentioned above can be obtained, and a scroll compressor having a scroll member with higher rigidity and reliability can be obtained.

Also, by applying surface treatment including zinc to the surface of the inner layer member 601, that is, applying surface treatment such as galvanizing to the surface of a steel material for example, adhesiveness with the outer layer member can be further improved.

In addition, instead of the uneven parts 603, depressions 604 and holes 605, the separation prevention parts may be arranged by welding and the like ribs and etc. on the surface of the inner layer member.

Further, although the disk-shape member 601(*a*) and the scroll-shape member 601(*b*) are constructed as separate bodies in the embodiment shown in FIG. 3, the disk-shape member 601(*a*) and the scroll-shape member 601(*b*) may be integrally formed as shown in FIG. 4, or otherwise the disk-shape member 601(*a*) and the scroll-shape member 601(*b*) may be manufactured as separate bodies followed by integration thereof by bonding, joining, or welding, and the like as shown in the embodiment of FIG. 5.

According to the present embodiment, a light-weight non-ferrous metal is employed for the outer layer member and an iron-based metal which is higher in strength and lower in cost compared with the non-ferrous metal is employed for the inner layer member, and therefore the scroll member can be manufactured at a lower cost without enlarging the size compared with the case the scroll member is constructed of a light-weight and highly strong single material.

Also, because the separation prevention parts of the plurality of uneven parts, depressions, holes or the like are arranged in the inner layer member, separation of the outer layer member with respect to the inner layer member due to the shearing stress by difference in coefficient of thermal expansion can be prevented, and a scroll compressor with high rigidity and reliability can be obtained.

What is claimed is:

1. A scroll compressor, comprising:

a stationary scroll; and an orbiting scroll, including: a scroll-shape wrap erected upright on a base plate, the scroll-shape wrap and base plate meshed with each other;

wherein at least the orbiting scroll includes:

an inner layer member including a core metal, wherein the inner layer member includes a disk-shape member disposed in the base plate and a scroll-shape member disposed in the wrap, and an outer layer member, arranged so as to surround the inner layer member, wherein the inner layer member includes a material with higher modulus of elasticity than the modulus of elasticity of the outer layer member;

wherein the disk-shape member and the scroll-shape member include separation prevention parts, the separation prevention parts including at least one of: uneven parts, depressions, and holes; and wherein the separation prevention parts are arranged more densely on a center part side of the scroll-shape member than on an outer peripheral part side of the scroll-shape member.

2. The scroll compressor according to claim 1, wherein the outer layer member of the wrap includes: a non-ferrous metal that is lighter in weight than the material of the inner layer member; and wherein the inner layer member includes: an iron-based metal having at least two times or higher modulus of elasticity than the modulus of elasticity of the outer layer member.

3. The scroll compressor according to claim 2, wherein the outer layer member includes an aluminum alloy; and wherein the inner layer member includes a steel plate or a steel material.

4. The scroll compressor according to claim 3, wherein the steel plate or the steel material in the inner layer members comprises either of SPHC grade steel or SPHE grade steel, as stipulated in the Japanese Industrial Standards (JIS).

5. The scroll compressor according to claim 1, wherein the inner layer member is arranged so as to extend in both a wrap and a base plate section of the orbiting scroll.

6. The scroll compressor according to claim 1, wherein the thickness of the scroll-shape member is 20-60% of the thickness of the whole wrap.

7. A scroll compressor used for a refrigeration cycle, comprising:

a plurality of scroll members, each including:

a base plate, and a scroll-shape wrap, wherein the scroll-shape wrap is erected upright on the base plate, the scroll-shape wrap and the base plate meshing with each other;

wherein a scroll member includes:

an inner layer member, including a core metal, and an outer layer member, arranged so as to surround the inner layer member;

wherein the inner layer member includes a material with higher modulus of elasticity than the modulus of elasticity of the outer layer member; and wherein the inner layer member includes separation prevention parts, configured to prevent the inner layer member and the outer layer member from separating from each other due to difference in coefficient of thermal expansion thereof, the separation prevention parts including at least one of: uneven parts, depressions, and holes;

wherein the separation prevention parts are arranged more densely on a center part side of the scroll-shape wrap than on an outer peripheral part side of the scroll-shape wrap.

8. The scroll compressor according to claim 1, wherein the inner layer member is subjected to a surface treatment including zinc, thereby improving the adhesiveness of the inner layer member with the outer layer member.

9. A scroll compressor, comprising:

a stationary scroll; and an orbiting scroll, including: a scroll-shape wrap erected upright on a base plate, the scroll-shape wrap and base plate being meshed with each other such that the orbiting scroll includes an outer layer member, arranged so as to surround an inner layer member, wherein the inner layer member including a core metal material with higher modulus of elasticity than the modulus of elasticity of the outer layer member;

wherein the base plate and the scroll-shape wrap include separation prevention parts, the separation prevention parts including at least one of: uneven parts, depressions, and holes; and wherein the separation prevention parts are arranged more densely on a center part side of the scroll-shape wrap than on an outer peripheral part side of the scroll-shape wrap.

* * * * *